US011739667B2

(12) United States Patent
Xi et al.

(10) Patent No.: US 11,739,667 B2
(45) Date of Patent: Aug. 29, 2023

(54) ENGINE VALVE ACTUATING APPARATUS

(71) Applicant: SHANGHAI UNIVERSOON AUTOTECH CO., LTD., Shanghai (CN)

(72) Inventors: Zheng Xi, Shanghai (CN); Rujie Zhu, Shanghai (CN); Zhiyang Lv, Shanghai (CN); Tao Wei, Shanghai (CN); Zhen Zhang, Shanghai (CN); Chunling Zeng, Shanghai (CN); Yong Xi, Shanghai (CN)

(73) Assignee: SHANGHAI UNIVERSOON AUTOTECH CO., LTD., Shanghai (CN)

( * ) Notice: Subject to any disclaimer, the term of this patent is extended or adjusted under 35 U.S.C. 154(b) by 5 days.

(21) Appl. No.: 17/753,160

(22) PCT Filed: Aug. 19, 2020

(86) PCT No.: PCT/CN2020/110102
§ 371 (c)(1),
(2) Date: Feb. 22, 2022

(87) PCT Pub. No.: WO2021/032136
PCT Pub. Date: Feb. 25, 2021

(65) Prior Publication Data

US 2022/0333512 A1 Oct. 20, 2022

(30) Foreign Application Priority Data

Aug. 19, 2019 (CN) ..... 201910763362.9
Jul. 14, 2020 (CN) ..... 202010676202.3

(51) Int. Cl.
*F01L 1/18* (2006.01)
*F01L 1/46* (2006.01)
(Continued)

(52) U.S. Cl.
CPC ..... *F01L 1/18* (2013.01); *F01L 1/46* (2013.01); *F01L 13/0005* (2013.01); *F01L 1/20* (2013.01)

(58) Field of Classification Search
CPC ..... F01L 1/18; F01L 1/20; F01L 1/46; F01L 13/0005
(Continued)

(56) References Cited

U.S. PATENT DOCUMENTS 8,813,719 B2 8/2014 Sailer et al.

FOREIGN PATENT DOCUMENTS

CN 102003242 A 4/2011
CN 102191965 A 9/2011
(Continued)

*Primary Examiner* — Jorge L Leon, Jr.
(74) *Attorney, Agent, or Firm* — NKL Law; Allen Xue

(57) ABSTRACT

An engine valve actuating apparatus includes a housing that contains an activation piston bore and an actuation piston bore. The activation piston is disposed in the activation piston bore and configured to actuate an engine valve. The actuation piston includes at least one side surface that is in sliding contact with the inner surface of the actuation piston bore so that the actuation piston can slide within the actuation piston bore. The actuation piston also has a guide mechanism, which guides the first and second links to move in a plane between the first position and the second position. At least a part of the guide mechanism is below at least a part of the at least one side surface of the actuation piston.

20 Claims, 8 Drawing Sheets

(51) Int. Cl.
*F01L 13/00* (2006.01)
*F01L 1/20* (2006.01)

(58) Field of Classification Search
USPC ..... 123/90.39, 90.45
See application file for complete search history.

(56) References Cited

FOREIGN PATENT DOCUMENTS

| | | | | |
|---|---|---|---|---|
| CN | 102840005 | A | | 12/2012 |
| CN | 104153836 | A | | 11/2014 |
| CN | 104279020 | A | * | 1/2015 |
| CN | 104279020 | A | | 1/2015 |
| CN | 107842407 | A | | 3/2018 |
| CN | 110486113 | A | | 11/2019 |
| CN | 210660239 | U | | 6/2020 |
| EP | 2384396 | B1 | | 6/2014 |
| KR | 20110012873 | A | | 2/2011 |
| WO | 2010078280 | A2 | | 7/2010 |

* cited by examiner

ENGINE VALVE ACTUATING APPARATUS

TECHNICAL FIELD

The present invention relates to an engine valve actuating apparatus.

BACKGROUND OF THE INVENTION

The conventional methods for actuating valves of vehicle engines are well known in the art and have been used for over a hundred years. However, due to the additional requirements for engine emission controls and engine braking, more and more engines require the addition of auxiliary valve motion, such as valve motion for exhaust gas recirculation and valve motion for engine braking, on the basis of conventional valve motion.

A conventional engine brake is a box-type hydraulic actuation mechanism placed on top of the engine. In order to accommodate this type of engine brakes, a gasket is added between the cylinder head and the engine cover to create additional space. This increases the height, weight and cost of the engine. These problems are caused by treating the engine braking system as an additional accessory to the engine, rather than as an integral part of the engine.

Another disadvantage of the hydraulic engine brake is the compliance of the hydraulic system, which is related to the compressibility of the hydraulic fluid. Compressibility of the hydraulic fluid results in a decrease in the brake valve lift, leading to an increase of the valve load. Higher valve load results in higher compliance of the hydraulic fluid, resulting in a vicious cycle. Furthermore, the degree of decrease in valve lift caused by hydraulic compliance increases with increase in engine speed, contrary to engine braking's requirement on braking valve lift.

The diameter of the hydraulic piston can be increased to reduce the compliance of the hydraulic system. This, however, leads to larger size and increased weight. Moreover, a larger diameter piston requires more fluid to move a given distance, and requires a longer time for hydraulic fluid to extend or retract the piston, resulting in larger inertia and slower response of the engine brake system.

EP 2384396 discloses a mechanical engine braking apparatus that overcomes the disadvantages of a hydraulic engine brake system. It transmits the engine braking load through a mechanical linkage that does not have the high compliance and overloading problems associated with a hydraulic engine braking system. As shown in FIGS. 25A, 25B and 26 of EP 2384396, the mechanical engine braking apparatus 100 is integrated into a rocker arm 210 of the engine exhaust valve train 200. (The reference numerals in this Background of the Invention are those used in EP 2384396.) The valve train 200 includes a cam 230, a cam follower 235, the rocker arm 210, a valve bridge 400, and the exhaust valves 300. The exhaust valves 300 are biased upwards against their seats 320 on the engine cylinder head 500 by engine valve springs 310 to seal gas from flowing between the engine cylinder (not shown) and the exhaust manifolds 600. The rocker arm 210 is pivotally mounted on a rocker shaft 205 for transmitting motion from the cam 230 to the exhaust valves 300 for their cyclical opening and closing.

The cam 230 contains a large lobe 220 above the inner base circle 225 mainly for normal engine operation and two small lobes 232 and 233 for engine braking operation. The rocker arm 210 is biased against the valve bridge 400 by a spring 198. A gap 234 is formed between the cam 230 and the cam follower 235 when the engine brake is not turned on.

When the engine brake is turned on, the small lobes 232 and 233 are engaged with the cam follower 235 to effect engine braking.

As shown in FIGS. 25A and 25B of EP 2384396, the engine braking apparatus 100 includes two linkage bars 184 and 186, and a braking piston 160 that slides in a vertical bore 190 in the brake housing 210. FIG. 25A of EP 2384396 shows a retracted position where the two pins guided in the slot 137 that is cut through a guiding piston 162 are pushed to the left by the spring 156. The guiding piston 162 slides in a horizontal bore 260 in the braking housing 210. There is an actuation piston 164 that slides in the guiding piston 162. The slot 137 in the guiding piston 162 has a width that is about the same as or slightly larger than the diameter of the two pins and a length that is smaller than the diameter of the bore 190. There is always contact (no separation) among the braking piston, the lower pin, the upper pin and the adjusting screw due to the upward force of the spring 177 that is secured to the brake housing 210 with at least one screw 179.

When engine brake is needed, the engine braking control is turned on and oil pressure can push both pistons 162 and 164 to the right against the preloads of the spring 156 and 177. Note that the actuation piston 164 can be moved to the right further to lock the two pins or toggles 184 and 186 in a straight position, as shown in FIG. 25B of EP 2384396. Now the toggle device is locked to its extended position on the operative position. The angle between the two pins or toggles 184 and 186 decides the height difference 130, while the angle itself is controlled by the two pistons 162 and 164. The bleeding orifice 168 in the guiding piston 162 is designed to eliminate hydraulic lock.

The engine braking apparatus of EP 2384396 still faces the issue of added height of the engine. Therefore, there is a need in the prior art to reduce the added height of an engine braking apparatus.

SUMMARY OF THE INVENTION

The present invention provides an engine valve actuating apparatus of a solid chain type to solve the problem of increased height of an engine with an engine braking system in the prior art.

According to embodiment 1 of the present invention, an engine valve actuating apparatus, comprising:

a housing, the housing including an activation piston bore and an actuation piston bore;

an activation piston disposed in the activation piston bore;

an actuation piston, wherein the actuation piston is disposed in the actuation piston bore to actuate an engine valve, where the actuation piston includes at least one side surface that is in sliding contact with the inner cylindrical surface of the actuation piston bore so that the actuation piston can slide within the actuation piston bore, the actuation piston comprising a guide mechanism, wherein the guide mechanism guides the first and second links to move in a plane between the first position and the second position, wherein at least a part of the guide mechanism is below at least a part of the at least one side surface of the actuation piston; and a link mechanism that includes a first link, a second link, a first rotational coupling connecting the first link and the housing, a second rotational coupling connecting the first link and the second link, and a third rotational coupling connecting the second link and the actuation piston, wherein the link mechanism has a first position and a second position, wherein at the first position, the actuation piston is disengaged with the engine valve, and wherein at the second position, the actuation piston is engaged with the engine valve to actuate the engine valve.

Embodiment 2 of the present invention includes the engine valve actuating apparatus according to embodiment 1, wherein there is an angle between the first link and the second link when the link mechanism is at the first position, and wherein at the second position, the first link and the second link are positioned on the same axis.

Embodiment 3 of the present invention includes the engine valve actuating apparatus according to embodiment 1 or 2, wherein the actuation piston and the guide mechanism form an integral or unitary part.

Embodiment 4 of the present invention includes the engine valve actuating apparatus according to any one of embodiments 1 to 3, wherein the guide mechanism is not above the at least one side surface of the actuation piston.

Embodiment 5 of the present invention includes the engine valve actuating apparatus according to any one of embodiments 1 to 4, wherein the guide mechanism comprises a guide groove, wherein the second link is disposed in the guide groove to guide the first and second links to move in a plane between the first position and the second position.

Embodiment 6 of the present invention includes the engine valve actuating apparatus according to embodiment 5, wherein the actuation piston comprises an anti-rotation mechanism, wherein the anti-rotation mechanism includes an anti-rotation surface that is perpendicular to the guide groove, and wherein the anti-rotation surface limits the rotation of the actuation piston in the actuation piston bore.

Embodiment 7 of the present invention includes the engine valve actuating apparatus according to any one of embodiments 1 to 5, wherein the actuation piston comprises an anti-rotation mechanism, wherein the anti-rotation mechanism limits the rotation of the actuation piston in the actuation piston bore, and wherein at least part of the anti-rotation mechanism is below at least a part of the at least one side surface of the actuation piston.

Embodiment 8 of the present invention includes the engine valve actuating apparatus according to embodiment 7, wherein the anti-rotation mechanism is not above the at least one side surface of the actuation piston.

Embodiment 9 of the present invention includes the engine valve actuating apparatus according to embodiment 7 or 8, wherein the actuation piston and the anti-rotation mechanism form an integral or unitary part.

Embodiment 10 of the present invention includes the engine valve actuating apparatus according to any one of embodiments 1 to 9, further comprising a positioning mechanism, wherein the positioning mechanism can position the link mechanism in the second position.

Embodiment 11 of the present invention includes the engine valve actuating apparatus according to embodiment 10, wherein the positioning mechanism can move the link mechanism from the second position to the first position.

Embodiment 12 of the present invention includes the engine valve actuating apparatus according to embodiment 10 or 11, wherein the positioning mechanism includes a returning spring and a returning ball, and wherein the returning spring acts on the link mechanism through the returning ball.

Embodiment 13 of the present invention includes the engine valve actuating apparatus according to any one of embodiments 10 to 12, wherein the positioning member includes an end surface, and wherein the end surface can engage with the anti-rotation surface to limit the rotation of the actuation piston in the actuation piston bore.

Embodiment 14 of the present invention includes the engine valve actuating apparatus according to any one of embodiments 1 to 9, further comprising a positioning mechanism, wherein the positioning mechanism includes a positioning member and a pushrod, wherein the positioning member includes a hole, and the pushrod is slidably disposed in the hole, wherein the pushrod has a retracted position and an extended position, wherein at the retracted position the pushrod positions the link mechanism at the second position, and the actuation piston is engaged with the engine valve, and wherein at the extended position the pushrod positions the link mechanism at the first position, and the actuation piston is disengaged with the engine valve.

Embodiment 15 of the present invention includes the engine valve actuating apparatus according to embodiment 14, wherein the positioning member includes an end surface, and wherein the end surface can engage with the anti-rotation surface to limit the rotation of the actuation piston in the actuation piston bore.

Embodiment 16 of the present invention includes the engine valve actuating apparatus according to embodiment 14 or 15, wherein the pushrod includes a plurality of cylindrical surfaces of different sizes, wherein the cylindrical surfaces form different stepped surfaces, wherein one of the cylindrical surface forms a sliding fit with the hole of the positioning member, wherein the diameter of the largest cylindrical surface is less than the width of the guide groove, wherein an end surface of the largest cylindrical surface is the positioning surface, and wherein the positioning surface engages with the link mechanism when the link mechanism is in the second position.

Embodiment 17 of the present invention includes the engine valve actuating apparatus according to any one of embodiments 14 to 16, wherein the positioning mechanism includes a returning spring and a retaining ring, wherein the returning spring has two ends that are respectively arranged on the positioning member and the pushrod, wherein the retaining ring is arranged on the pushrod, and wherein the retaining ring and one of the stepped surfaces limits the movement of the push rod between the retracted position and the extended position.

Embodiment 18 of the present invention includes the engine valve actuating apparatus according to any one of embodiments 14 to 17, wherein the positioning member is a screw plug that is screwed into the housing.

The engine valve actuating apparatus according to any one of claims 10 to 18, wherein at least a part of the guide mechanism extends into the space between the positioning mechanism and the activation piston.

Embodiment 20 of the present invention includes the engine valve actuating apparatus according to any one of embodiments 1 to 19, further comprising an actuation piston spring, wherein the actuation piston spring acts on the actuation piston to keep the actuation piston and the second link in contact.

Embodiment 21 of the present invention includes the engine valve actuating apparatus according to any one of embodiments 1 to 20, wherein the housing includes a fluid channel connecting the activation piston bore and an engine oil supply, wherein engine oil pressure acts on the activation piston disposed in the activation piston bore to move the link mechanism from the first position to the second position.

Embodiment 22 of the present invention includes the engine valve actuating apparatus according to any one of embodiments 1 to 21, wherein all three rotational couplings are spherical rotational couplings.

Embodiment 23 of the present invention includes the engine valve actuating apparatus according to any one of embodiments 1 to 22, wherein the housing includes a valve lash adjusting screw, and the valve lash adjusting screw and the first link form the first rotational coupling.

Embodiment 24 of the present invention includes the engine valve actuating apparatus according to any one of embodiments 1 to 23, wherein the housing is a rocker arm of the engine.

Embodiment 25 of the present invention includes the engine valve actuating apparatus according to any one of embodiments 1 to 23, wherein the housing is a valve bridge of the engine.

According to embodiment 26 of the present invention, an engine valve actuating apparatus, comprising:

a housing, the housing including an activation piston bore and an actuation piston bore;

an activation piston disposed in the activation piston bore;

an actuation piston, wherein the actuation piston is disposed in the actuation piston bore to actuate an engine valve, where the actuation piston includes at least one side surface that is in sliding contact with the inner cylindrical surface of the actuation piston bore so that the actuation piston can slide within the actuation piston bore, the actuation piston comprising an anti-rotation mechanism, wherein the anti-rotation mechanism limits the rotation of the actuation piston in the actuation piston bore, and wherein at least a part of the anti-rotation mechanism is below at least a part of the at least one side surface of the actuation piston; and a link mechanism that includes a first link, a second link, a first rotational coupling connecting the first link and the housing, a second rotational coupling connecting the first link and the second link, and a third rotational coupling connecting the second link and the actuation piston, wherein the link mechanism has a first position and a second position, wherein at the first position, the actuation piston is disengaged with the engine valve, and wherein at the second position, the actuation piston is engaged with the engine valve to actuate the engine valve.

Embodiment 27 of the present invention includes the engine valve actuating apparatus according to embodiment 26, wherein there is an angle between the first link and the second link when the link mechanism is at the first position, and wherein at the second position, the first link and the second link are positioned on the same axis.

Embodiment 28 of the present invention includes the engine valve actuating apparatus according to embodiment 26 or 27, wherein the anti-rotation mechanism includes an anti-rotation surface, and wherein the anti-rotation surface limits the rotation of the actuation piston in the actuation piston bore.

Embodiment 29 of the present invention includes the engine valve actuating apparatus according to any one of embodiments 26 to 28, wherein the anti-rotation mechanism is not above the at least one side surface of the actuation piston.

Embodiment 30 of the present invention includes the engine valve actuating apparatus according to any one of embodiments 26 to 29, wherein the actuation piston and the anti-rotation mechanism form an integral or unitary part.

Embodiment 31 of the present invention includes the engine valve actuating apparatus according to any one of embodiments 26 to 30, further comprising a positioning mechanism, wherein the positioning mechanism can position the link mechanism in the second position.

Embodiment 32 of the present invention includes the engine valve actuating apparatus according to embodiment 31, wherein the positioning mechanism can move the link mechanism from the second position to the first position.

Embodiment 33 of the present invention includes the engine valve actuating apparatus according to embodiment 31 or 32, wherein the positioning mechanism includes a returning spring and a returning ball, and wherein the returning spring acts on the link mechanism through the returning ball.

Embodiment 34 of the present invention includes the engine valve actuating apparatus according to any one of embodiments 31 to 33, wherein the positioning member includes an end surface, and wherein the end surface can engage with the anti-rotation surface to limit the rotation of the actuation piston in the actuation piston bore.

Embodiment 35 of the present invention includes the engine valve actuating apparatus according to any one of embodiments 26 to 30, further comprising a positioning mechanism, wherein the positioning mechanism includes a positioning member and a pushrod, wherein the positioning member includes a hole, and the pushrod is slidably disposed in the hole, wherein the pushrod has a retracted position and an extended position, wherein at the retracted position the pushrod positions the link mechanism at the second position, and the actuation piston is engaged with the engine valve, and wherein at the extended position the pushrod positions the link mechanism at the first position, and the actuation piston is disengaged with the engine valve.

Embodiment 36 of the present invention includes the engine valve actuating apparatus according to embodiment 35, wherein the positioning member includes an end surface, and wherein the end surface can engage with the anti-rotation surface to limit the rotation of the actuation piston in the actuation piston bore.

Embodiment 37 of the present invention includes the engine valve actuating apparatus according to embodiment 35 or 36, wherein the pushrod includes a plurality of cylindrical surfaces of different sizes, wherein the cylindrical surfaces form different stepped surfaces, wherein one of the cylindrical surface forms a sliding fit with the hole of the positioning member, wherein an end surface of the largest cylindrical surface is the positioning surface, and wherein the positioning surface engages with the link mechanism when the link mechanism is in the second position.

Embodiment 38 of the present invention includes the engine valve actuating apparatus according to any one of embodiments 35 to 37, wherein the positioning mechanism includes a returning spring and a retaining ring, wherein the returning spring has two ends that are respectively arranged on the positioning member and the pushrod, wherein the retaining ring is arranged on the pushrod, and wherein the retaining ring and one of the stepped surfaces limits the movement of the push rod between the retracted position and the extended position.

Embodiment 39 of the present invention includes the engine valve actuating apparatus according to any one of embodiments 35 to 38, wherein the positioning member is a screw plug that is screwed into the housing.

Embodiment 40 of the present invention includes the engine valve actuating apparatus according to any one of embodiments 26 to 39, further comprising an actuation piston spring, wherein the actuation piston spring acts on the actuation piston to keep the actuation piston and the second link in contact.

Embodiment 41 of the present invention includes the engine valve actuating apparatus according to any one of embodiments 26 to 40, wherein the housing includes a fluid channel connecting the activation piston bore and an engine oil supply, wherein engine oil pressure acts on the activation piston disposed in the activation piston bore to move the link mechanism from the first position to the second position.

Embodiment 42 of the present invention includes the engine valve actuating apparatus according to any one of embodiments 26 to 41, wherein all three rotational couplings are spherical rotational couplings.

Embodiment 43 of the present invention includes the engine valve actuating apparatus according to any one of embodiments 26 to 42, wherein the housing includes a valve lash adjusting screw, and the valve lash adjusting screw and the first link form the first rotational coupling.

Embodiment 44 of the present invention includes the engine valve actuating apparatus according to any one of embodiments 26 to 43, wherein the housing is a rocker arm of the engine.

Embodiment 45 of the present invention includes the engine valve actuating apparatus according to any one of embodiments 26 to 43, wherein the housing is a valve bridge of the engine.

According to embodiment 46 of the present invention, an engine valve actuating apparatus, comprising:

a housing, the housing including an activation piston bore and an actuation piston bore;

an activation piston disposed in the activation piston bore;

an actuation piston, wherein the actuation piston is disposed in the actuation piston bore to actuate an engine valve, where the actuation piston includes at least one side surface that is in sliding contact with the inner cylindrical surface of the actuation piston bore so that the actuation piston can slide within the actuation piston bore;

a link mechanism that includes a first link, a second link, a first rotational coupling connecting the first link and the housing, a second rotational coupling connecting the first link and the second link, and a third rotational coupling connecting the second link and the actuation piston, wherein the link mechanism has a first position and a second position, wherein at the first position, the actuation piston is disengaged with the engine valve, and wherein at the second position, the actuation piston is engaged with the engine valve to actuate the engine valve; and a positioning mechanism, wherein the positioning mechanism includes a positioning member and a pushrod, wherein the positioning member includes a hole, and the pushrod is slidably disposed in the hole, and wherein the pushrod has a retracted position and an extended position.

Embodiment 47 of the present invention includes the engine valve actuating apparatus according to embodiment 46, wherein there is an angle between the first link and the second link when the link mechanism is at the first position, and wherein at the second position, the first link and the second link are positioned on the same axis.

Embodiment 48 of the present invention includes the engine valve actuating apparatus according to embodiment 46 or 47, wherein at the retracted position the pushrod positions the link mechanism at the second position, and the actuation piston is engaged with the engine valve, and wherein at the extended position the pushrod positions the link mechanism at the first position, and the actuation piston is disengaged with the engine valve.

Embodiment 49 of the present invention includes the engine valve actuating apparatus according to any one of embodiments 46 to 48, wherein the pushrod includes a plurality of cylindrical surfaces of different sizes, wherein the cylindrical surfaces form different stepped surfaces, wherein one of the cylindrical surface forms a sliding fit with the hole of the positioning member, wherein an end surface of the largest cylindrical surface is the positioning surface, and wherein the positioning surface engages with the link mechanism when the link mechanism is in the second position.

Embodiment 50 of the present invention includes the engine valve actuating apparatus according to any one of embodiments 46 to 49, wherein the positioning mechanism includes a returning spring and a retaining ring, wherein the retaining spring has two ends that are respectively arranged on the positioning member and the pushrod, wherein the retaining ring is arranged on the pushrod, and wherein the retaining ring and one of the stepped surfaces limits the movement of the push rod between the retracted position and the extended position.

Embodiment 51 of the present invention includes the engine valve actuating apparatus according to any one of embodiments 46 to 50, wherein the positioning member is a screw plug that is screwed into the housing.

Embodiment 52 of the present invention includes the engine valve actuating apparatus according to any one of embodiments 46 to 51, further comprising an actuation piston spring, wherein the actuation piston spring acts on the actuation piston to keep the actuation piston and the second link in contact.

Embodiment 53 of the present invention includes the engine valve actuating apparatus according to any one of embodiments 46 to 52, wherein the housing includes a fluid channel connecting the activation piston bore and an engine oil supply, wherein engine oil pressure acts on the activation piston disposed in the activation piston bore to move the link mechanism from the first position to the second position.

Embodiment 54 of the present invention includes the engine valve actuating apparatus according to any one of embodiments 46 to 53, wherein all three rotational couplings are spherical rotational couplings.

Embodiment 55 of the present invention includes the engine valve actuating apparatus according to any one of embodiments 46 to 54, wherein the housing includes a valve lash adjusting screw, and the valve lash adjusting screw and the first link form the first rotational coupling.

Embodiment 56 of the present invention includes the engine valve actuating apparatus according to any one of embodiments 46 to 55, wherein the housing is a rocker arm of the engine.

Embodiment 57 of the present invention includes the engine valve actuating apparatus according to any one of embodiments 46 to 55, wherein the housing is a valve bridge of the engine.

According to embodiment 58 of the present invention, a method for positioning an engine valve actuating device, comprising:

installing an activation piston in an activation piston bore;

installing an assembly fixture in the actuation piston bore, wherein the assembly fixture includes a large cylindrical surface and a small cylindrical surface, the large cylindrical surface forming a slidable fit with an actuation piston bore, and the small cylindrical surface having the same or a similar diameter as a first link or a second link;

inserting a positioning member of a positioning mechanism in a housing until a pushrod of the positioning mechanism contacts the small cylindrical surface of the assembly fixture and generates a predetermined installation resistant force;

fastening the positioning member of the positioning mechanism on the housing;

removing the assembly fixture from the actuation piston bore; and installing the connecting bars and other parts of the engine valve actuating device.

Embodiment 59 of the present invention includes the method for positioning an engine valve actuating device according to embodiment 58, wherein the step of fastening the positioning member of the positioning mechanism on the housing includes one or more of welding, riveting, threading and impacting threads.

According to embodiment 60 of the present invention, an engine valve actuating apparatus, comprising:

a housing including an activation piston bore and an actuation piston bore, wherein the actuation piston bore has a cylindrical inner surface;

an activation piston disposed in the activation piston bore;

an actuation piston disposed in the actuation piston bore to actuate an engine valve;

a positioning mechanism; and a link mechanism, wherein the link mechanism has a first position and a second position, wherein the activation piston and the positioning mechanism move the link mechanism between the first position and the second position;

wherein the actuation piston includes a narrow top portion, wherein at least part of the narrow top portion extends into the space between the positioning mechanism and the activation piston, wherein the at least part of the narrow top portion includes a side surface, wherein the side surface is in a sliding fit with the cylindrical inner surface of the actuation piston bore to guide the movement of the actuation piston in the actuation piston bore.

Embodiment 61 of the present invention includes the engine valve actuating apparatus according to embodiment 60, wherein the actuation piston includes a cylindrical bottom portion, wherein the cylindrical bottom portion is too large to extend into the space between the positioning mechanism and the activation piston.

Embodiment 62 of the present invention includes the engine valve actuating apparatus according to embodiment 60 or 61, wherein the link mechanism includes a first link and a second link, wherein there is an angle between the first link and the second link when the link mechanism is at the first position, and wherein at the second position, the first link and the second link are positioned on the same axis.

Embodiment 63 of the present invention includes the engine valve actuating apparatus according to any one of embodiments 60 to 62, wherein the narrow top portion of the actuation piston includes a guide groove, wherein the second link is disposed in the guide groove to guide the first and second links to move in a plane between the first position and the second position.

Embodiment 64 of the present invention includes the engine valve actuating apparatus according to any one of embodiments 60 to 63, wherein the narrow top portion of the actuation piston includes an anti-rotation mechanism, wherein the anti-rotation mechanism includes an anti-rotation surface that is perpendicular to the guide groove, and wherein the anti-rotation surface limits the rotation of the actuation piston in the actuation piston bore.

Embodiment 65 of the present invention includes the engine valve actuating apparatus according to any one of embodiments 60 to 64, wherein the positioning mechanism can position the link mechanism in the second position.

Embodiment 66 of the present invention includes the engine valve actuating apparatus according to embodiment 65, wherein the positioning mechanism can move the link mechanism from the second position to the first position.

Compared with the prior art, the present invention has positive and obvious effects. The present invention can be integrated with the engine, thereby reducing the height, volume and weight of the engine; a hydraulic control valve is not needed, so that the cost is reduced, and the reaction time is reduced; without hydraulic loading, leakage, deformation and load fluctuation caused by high oil pressure and high oil temperature are avoided, the valve lift is not influenced by oil temperature, oil pressure and air content, the valve lift can be designed smaller, and the clearance between the piston and the valve of the engine is reduced.

DETAILED DESCRIPTION OF THE EMBODIMENTS

Figure 1:
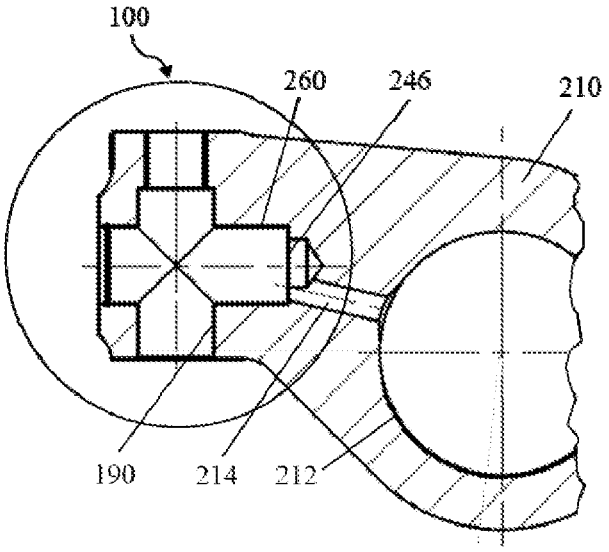
FIG. 1 is a schematic view of a housing of an engine valve actuating apparatus according to an embodiment of the present invention.
Figure 2:
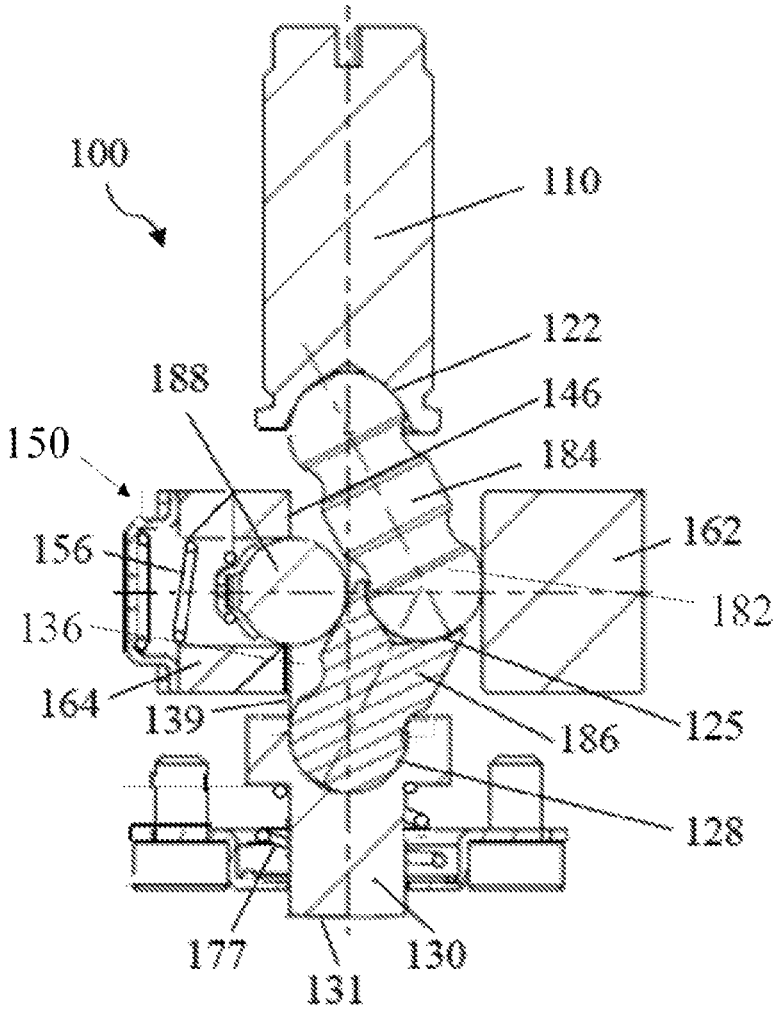
FIG. 2 is a schematic view of the engine valve actuating apparatus in a first position according to the embodiment shown in FIG. 1.
Figure 3:
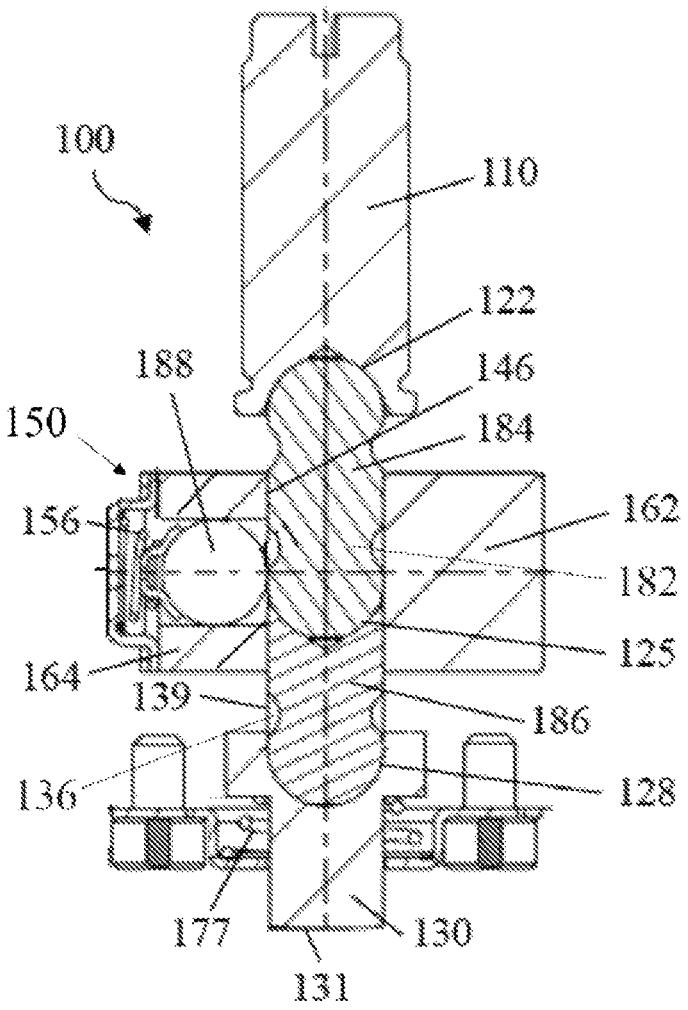
FIG. 3 is a schematic view of the engine valve actuating apparatus in a second position according to the embodiment shown in FIGS. 1 and 2.

According to an embodiment of the present invention, as shown in FIGS. 1, 2 and 3, an engine valve actuating apparatus 100 may include a housing 210, an activation piston 162, an actuation piston 130, a link mechanism 182, and one or more of a guide mechanism 137, an anti-rotation mechanism 138 and a positioning mechanism 150.

The housing 210 may be a rocker arm or valve bridge of the engine. In this embodiment, the housing 210 is a rocker arm, which may be similar to the rocker arm (210b) of EP 2384396. As shown in FIG. 1, the rocker arm is mounted on a rocker shaft (not shown) through a hole 212.

As shown in FIG. 1, the housing 210 includes an activation piston bore 260 and an actuation piston bore 190. Preferably, the activation piston bore 260 and the actuation piston bore 190 intersect each other perpendicularly. The activation piston 162 is slidably disposed in the activation piston bore 260. The actuation piston 130 is disposed in the actuation piston bore 190 to actuate an engine valve (not shown in Figures).

The link mechanism 182 includes a first link 184, a second link 186, a first rotational coupling 122 connecting the first link 184 and the housing 210, a second rotational coupling 125 connecting the first link 184 and the second link 186, and a third rotational coupling 128 connecting the second link 186 and the actuation piston 130. The three rotational couplings 122, 125 and 128 illustrated in this embodiment are spherical rotational couplings (ball and ball socket mating), although they may have any one or more suitable structures. The link mechanism 182 has a first position (as shown in FIG. 2) and a second position (as shown in FIG. 3). At the first position, the actuation piston 130 is retracted into the housing 210 and is disengaged with the engine valve, and at the second position, the actuation piston 130 extends out of the housing 210 and is engaged with the engine valve to actuate the engine valve.

The actuation piston according to some embodiments of the present invention may be broadly defined. The actuation piston may include any and all structures that are connected directly or indirectly to a member that is designed to contact the engine valve to actuate the engine valve. Some or all of these structures may be structures that are rigidly connected to the member so that there is neither translational nor rotational relative movement between the member and the structures, while it's possible for other structures not to be so rigidly connected to the member. As used herein, the term "rigidly connected" is defined as being integrally or unitarily formed. The term "integrally formed" is defined as being formed from parts that were separate and later connected; the term "unitarily formed" is defined as being formed from a same piece of material.

According to this embodiment of the invention, the actuation piston 130 may include one or more side surfaces that are in sliding contact with the inner cylindrical surface of the actuation piston bore 190 so that the actuation piston 130 can slide within the actuation piston bore 190. All or some of the one or more side surfaces may be connected to each other, or all or some of them may be separate surfaces that are not connected to each other. For example, the one or more surfaces may be separated by a piston ring or by some other structure. In the embodiment shown in FIGS. 4 and 5, the one or more side surfaces of the actuation piston 130 is the side surface 135 of the actuation piston 130. The one or more side surfaces 135 of the actuation piston 130 are in sliding contact with the inner cylindrical surface of the actuation piston bore 190 so that the actuation piston 130 can slide within the actuation piston bore 190.

The actuation piston 130 includes a guide mechanism 137 that guides the first and second links 184, 186 to move in a vertical plane as the link mechanism 182 moves between the first position and the second position. This helps align the first and second positions of the link mechanism 182 with the activation piston 162 and the positioning mechanism 150 so that the activation piston 162 and the positioning mechanism 150 can push the link mechanism 182 between the first and second positions. In some embodiments, the vertical plane may pass through the axes of the activation piston 162 and the positioning mechanism 150 to ensure that the activation piston 162 and the positioning mechanism 150 can push the link mechanism 182 between the first position and the second position or to ensure that when the link mechanism 182 is in its second position, the first and second links 184, 186 are coaxial.

In the embodiment shown in FIGS. 2 to 5, for example, the guide mechanism 137 includes a groove 137 on the top portion of the actuation piston 130. The second link 186 is engaged with the actuation piston 130 by way of the third rotational coupling 128 located inside the groove 137. The width and depth of the groove 137 are selected so that the groove 137 keeps the movement of the second link 186, and therefore that of the first link 184, along the groove 137 in a vertical plane between the first position and the second position of the link mechanism 182. For example, the width of the groove 137 may be equal to, or slightly larger than, the width of the second link 186 so that the second link 186 can move along the groove 137 in a vertical plane.

Figure 4:
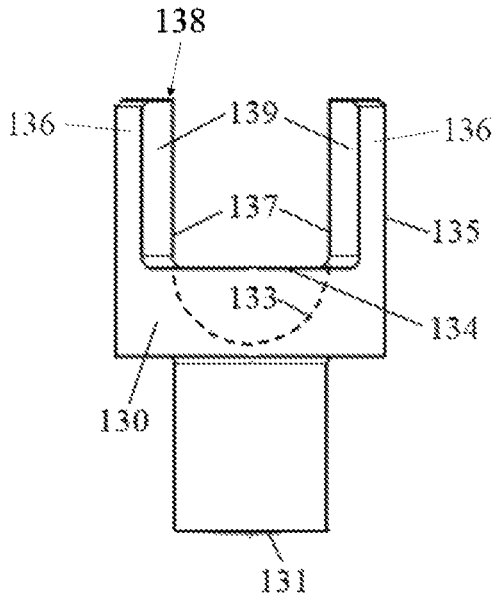
FIG. 4 is a front view of an actuation piston of the engine valve actuating apparatus according to the embodiment shown in FIGS. 1-3.
Figure 5:
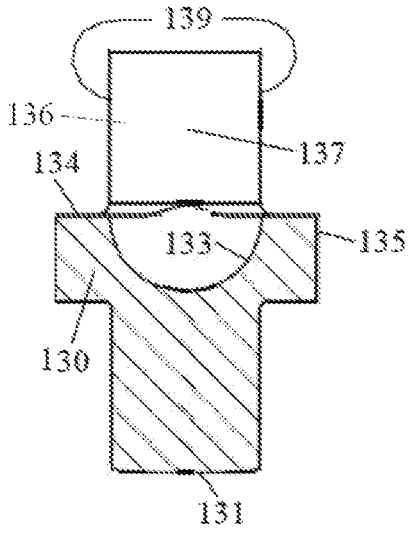
FIG. 5 is a side view (cross-sectional view along an axis) of the actuation piston of the engine valve actuating apparatus according to the embodiment shown in FIGS. 1-4.

As shown in FIGS. 4 and 5, the groove 137 is defined by two vertical members 136. Preferably, the width of each vertical member 136 in the circumstantial direction of the actuation piston 130 is sufficiently small so that each vertical member 136 can extend into the space between the activation piston 162 and the positioning mechanism 150, as the actuation piston 130 moves up and down in engine operation. As used in this application, the term "extending into the space" means that, using the above sentence as an example, at least one part of each vertical member 136 is above at least one part of the actuation piston 130 and the positioning mechanism 150. In another preferred embodiment, the vertical members 136 may have side surfaces 135 that are in contact with the inner surface of the actuation piston bore 190 to guide the actuation piston 130 as the actuation piston 130 slides up and down in the actuation piston bore 190. Preferably, the side surfaces 135 of the vertical members 136 are partial cylindrical surfaces that are part of the cylindrical side surface 135 of the actuation piston 130.

In FIGS. 2 and 3, only one of the vertical members 136 is shown. This vertical member 136 is behind the link mechanism 182 and can be seen extending into the space between the activation piston 162 and the positioning mechanism 150. The other vertical member 136 is in front of the link mechanism 182 and not shown because FIGS. 2 and 3 are cross-sectional views. The figures show that the cylindrical portion of the actuation piston 130 cannot extend into the space between activation piston 162 and the positioning mechanism 150, because the diameter of the cylindrical portion is greater than the width of the space. The vertical members 136 can extend into the space because the width of the vertical members 136 is less than the width of the space.

Preferably at least a part of the guide mechanism 137 is below at least a part of the one or more side surfaces 135 of the actuation piston 130, or the guide mechanism 137 is not above the one or more side surfaces of the actuation piston 130, as shown FIGS. 5 and 6. The term "not above" as used herein means that no part of the guide mechanism 137 is above any part of the one or more side surfaces 135 of the actuation piston 130. In the illustrated embodiment, the guide mechanism 137 (i.e., the guide groove 137) is not above the one or more side surfaces 135 of the actuation piston 130. Moving the guide mechanism 137 further inside the actuation piston 130 allows the actuation piston 130 to move up into the space between the activation piston 162 and the positioning mechanism 150, thus reducing the height of the engine valve actuating apparatus 100, as discussed below.

Although the guide mechanism 137 shown in FIGS. 2 to 5 includes a groove 137, it may have one or more other structures that keep the movement of the first and second links 184, 186 in a vertical plane as the link mechanism 182 moves between the first position and the second position.

For example, the guide mechanism may be a pin joint that rotationally connects the second link 186 to the actuation piston 130. The pin joint can keep the movement of the first and second links 184, 186 in a vertical plane.

The actuation piston 130 of the present embodiment has a number of advantages over the prior art. One of the advantages is that the total height of the engine valve actuating apparatus 100 can be reduced. The height of the engine valve actuating apparatus 100 is determined by the length of the first link 184, the length of the second link 186 and the distance between the lower end of the second link 186 and the bottom end of the actuation piston 130. The lengths of the first and second links 184, 186 and the height of the actuation piston 130 are determined by engine valve operation. Therefore, to reduce the height of the engine valve actuating apparatus 100, the distance between the lower end of the second link 186 and the bottom end of the actuation piston 130 needs to be reduced. However, due to the required minimum height of the actuation piston 130, if this distance is reduced too much, the top edge of the actuation piston 130 would collide with the positioning mechanism 150 or the activation piston 162. Additionally, the guide groove in the prior art is placed on the surface of the activation piston facing the positioning mechanism. As a result, the guiding groove of the prior art extends into the space between the activation piston and the positioning mechanism, making it more difficult for the actuation piston to extend into the space. Therefore, it is difficult to reduce the height of the prior art engine valve actuating apparatus.

The above-discussed embodiments of the present invention can overcome these disadvantages of the prior art. In this embodiment of the present invention shown in the FIGS. 1-5, for example, the guide mechanism 137 is now part of the actuation piston 130 (instead of being part of the activation piston 162 as is the case with prior art), opening up the space between the activation piston 162 and the positioning mechanism 150 so that the actuation piston 130 can extend thereinto.

Furthermore, the actuation piston 130 has a narrow top portion, i.e., the vertical members 136. The narrow top portion makes it possible for the top portion of the actuation piston 130 to extend into the space between the position mechanism and the activation piston 162 without colliding with the activation piston 162 or the positioning mechanism 150. This allows the third rotational coupling 128 to extend further into the actuation piston 130 while still maintaining the required minimum height of the actuation piston 130, making it possible to reduce the height of the engine valve actuating apparatus 100 by reducing the distance between the lower end of the second link 186 and the bottom end of the actuation piston 130. The narrow top portion of the actuation piston 130 helps maintain the required height of the actuation piston 130 because the outer side surfaces of the narrow top portion are in contact with the inner surface of the actuation piston bore 190 and guide the actuation piston 130 to slide within the actuation piston bore 190. Preferably, the outer side surfaces of the top portion have the same cylindrical side surface as the rest of the actuation piston 130. This increases the contact area between the outer side surfaces of the top portion and the actuation piston bore 190 to better guide the movement of the actuation piston 130.

According to another embodiment of the invention, an engine valve actuating apparatus 100 includes an actuation piston 130 that includes an anti-rotation mechanism 138. The anti-rotation mechanism 138 limits the rotation of the actuation piston 130 within the actuation piston bore 190, thus limiting the rotation of the link mechanism 182. Limiting the rotation of the actuation piston 130 helps align the first and second positions of the link mechanism 182 with the activation piston 162 and the positioning mechanism 150 so that the activation piston 162 and the positioning mechanism 150 can move the link mechanism 182 between the first and second positions.

In the embodiment shown in FIGS. 2 to 5, the anti-rotation mechanism 138 includes an anti-rotation surface 139 that is perpendicular to the guide groove 137. Specifically, the anti-rotation surface 139 includes the surface of each vertical member 136 that is in contact with the positioning mechanism 150 as shown in FIGS. 2 and 3. When the anti-rotation surface 139 of the two vertical members 136 are in contact with the positioning mechanism 150 as shown in FIGS. 2 and 3, the rotation of the actuation piston 130 within the actuation piston bore 190, thus the rotation of the link mechanism 182, is limited.

Preferably, at least part of the anti-rotation mechanism 138 is below at least a part of the one or more side surfaces 135 of the actuation piston 130, or the anti-rotation mechanism 138 is not above the one or more side surfaces 135 of the actuation piston 130. In the illustrated embodiment, the anti-rotation mechanism 138 (i.e., the surface 139 of each vertical member 136 that is in contact with the positioning mechanism 150) is not above the one or more side surfaces 135 of the actuation piston 130. Moving the anti-rotation mechanism 138 further inside the actuation piston 130 allows the actuation piston 130 to move up into the space between the activation piston 162 and the positioning mechanism 150, thus reducing the height of the engine valve actuating apparatus 100, as discussed below.

According to a further embodiment of the present invention, an engine valve actuating apparatus 100 may include a positioning mechanism 150 that can position the link mechanism 182 in the second position. The positioning mechanism 150 can also move the link mechanism 182 from the second position to the first position.

The positioning mechanism 150 may include a returning spring 156 and a returning ball 188. The returning spring 156 may act on the link mechanism 182 through the returning ball 188. In the first position, the returning spring 156 and the returning ball 188 of the positioning mechanism 150 push the activation piston 162 against the bottom surface 246 of the activation piston bore 260 via the first link 184 and the second link 186 (FIG. 1), wherein the first link 184 and the second link 186 forming an angle (FIG. 2). At this point, an actuation piston spring 177 pushes the actuation piston 130 upward, and the actuation piston 130 is disengaged with the engine valve (not shown). When the engine valve actuating apparatus 100 needs to be activated, an engine oil fluid network (not shown) supplies oil to the activation piston bore 260 through a fluid passage 214 in the housing 210 (FIG. 1). The pressure of the engine oil acts on the activation piston 162 to overcome the forces of the returning spring 156 and the actuation piston spring 177, and pushes the first link 184 and the second link 182 from the first position to the second position along the guide groove 137 (FIG. 3). In the second position, the first link 184 and the second link 186 are substantially coaxial, and the actuation piston 130 is pushed down to engage with the engine valve.

The positioning mechanism 150 has a hollow cylinder 164, in which the returning ball 188 and returning spring 156 are placed. The end face 146 of the hollow cylinder 164 may be in contact with the first link 184 and the second link 186 when the link mechanism 182 is in the second position. This ensures that the first link 184 and the second link 186 remain substantially coaxial in the second position (see FIG. 3), and the actuation piston 130 is engaged with the engine valve to actuate the engine valve.

The end face 146 of the hollow cylinder 164 may be in contact with the anti-rotation surfaces 139 of the anti-rotation mechanism 138 to limit the rotation of the actuation piston 130 in the actuation piston bore 190.

According to a still further embodiment of the present invention, an engine valve actuating apparatus 100 may include an adjusting screw 110 installed on the housing 210. The adjusting screw 110 is used to adjust vertically the initial position (valve lash) of the actuation piston 130 in the actuation piston bore 190. In the case where the initial position of the actuation piston 130 does not need to be adjusted, the adjusting screw 110 is not required, and the first rotational coupling 122 is directly formed between the first link 184 and the housing 210.

A method for operating the engine valve actuating apparatus 100 is described as follows.

When the engine valve actuating apparatus 100 is required to actuate the engine valve, engine oil is supplied to the activation piston bore 260 from the engine oil fluid network (not shown) via the fluid passage 214 in the housing 210 (see FIG. 1), and the pressure of the engine oil acts on the activation piston 162 to overcome the forces of the returning spring 156 and the actuation piston spring 177, and to push the link mechanism 182 from the first position (FIG. 2) to the second position (FIG. 3) along the guide groove 137. The actuation piston 130 is changed from the retracted position to the extended position to engage the engine valve. As a result, the motion of the engine cam (not shown) is transmitted to the engine valve through the rocker arm 210 and the engine valve actuating apparatus 100, resulting in a desired valve motion, such as the valve motion for engine braking.

When the engine valve actuating apparatus 100 is not required to work, the engine oil supply is turned off so that the activation piston 162 is no longer subjected to oil pressure. The returning spring 156 pushes the activation piston 162 to retract and eventually rest on the bottom surface 246 of the activation piston bore 260, and the link mechanism 182 returns to the first position. The actuation piston 130 retracts upward further into the actuation piston bore 190 under the action of the actuation piston spring 177, and disengages with the engine valve. This generates a certain distance between actuation piston 130 and engine valve to skip the motion of the engine cam (not shown).

According to another embodiment of the present invention, an engine valve actuating apparatus is similar to the embodiment shown in FIGS. 1-5, but does not have the same structure. Therefore, this embodiment is described using FIGS. 1-5 and the reference numerals therein. Although the below description of this embodiment refers to the reference numerals of FIGS. 1-5, it does not mean that this embodiment and its components are the same as the one shown in FIGS. 1-5.

According to this embodiment, the engine valve actuating apparatus includes a housing 210 that includes an activation piston bore 260 and an actuation piston bore 190, the actuation piston bore 190 having a cylindrical inner surface; an activation piston 162 disposed in the activation piston bore 260; an actuation piston 130 disposed in the actuation piston bore 190 to actuate an engine valve; a positioning mechanism 150; and a link mechanism 182, wherein the link mechanism 182 has a first position and a second position, wherein the actuation piston 130 and the positioning mechanism 150 move the link mechanism 182 between the first position and the second position.

According to this embodiment, the actuation piston 130 includes a narrow top portion 136. When the link mechanism 182 is at the first position, at least part of the narrow top portion 136 extends into the space between the positioning mechanism 150 and the activation piston 162. The at least part of the narrow top portion 136 includes a side surface, which has a sliding fit with the cylindrical inner surface of the actuation piston bore 190 to guide the movement of the actuation piston 130 in the actuation piston bore 190. The narrow top 136 may include the two vertical members 136.

Optionally, the actuation piston 130 may include a cylindrical bottom portion that is too large to extend into the space between the positioning mechanism 150 and the activation piston 162.

The narrow top portion 136 of the actuation piston 130 may include a guide groove 137, and the second link is disposed in the guide groove 137 to guide the first and second links to move in a plane between the first position and the second position. Alternatively, the narrow top portion 136 may not have the guide groove 137. Instead the engine valve actuating apparatus may have one or more other structures that keep the movement of the first and second links 184, 186 in a vertical plane as the link mechanism 182 moves between the first position and the second position. For example, the guide mechanism may be a pin joint that rotationally connects the second link 186 to the actuation piston 130. The pin joint can keep the movement of the first and second links 184, 186 in a vertical plane. Alternatively, a guide groove or a pin joint may be placed at the connection between the first link and the housing (or the valve lash adjusting screw).

The narrow top portion 136 of the actuation piston 130 may also include an anti-rotation mechanism 138, which includes an anti-rotation surface that is perpendicular to the guide groove 137. Alternatively, the narrow top portion 136 may not have the anti-rotation mechanism 138. Instead a guide groove or a pin joint may be placed at the connection between the first link and the housing (or the valve lash adjusting screw) to function as an anti-rotation mechanism.

The positioning mechanism 150 of this embodiment may position the link mechanism 182 in the second position. The positioning mechanism 150 can move the link mechanism 182 from the second position to the first position.

FIGS. 6-9 illustrate a further embodiment of the invention. An engine valve actuating apparatus 200 according to this further embodiment is similar to the embodiment shown in FIGS. 1-5, except that the further embodiment has a different positioning mechanism 250.

Figure 6:
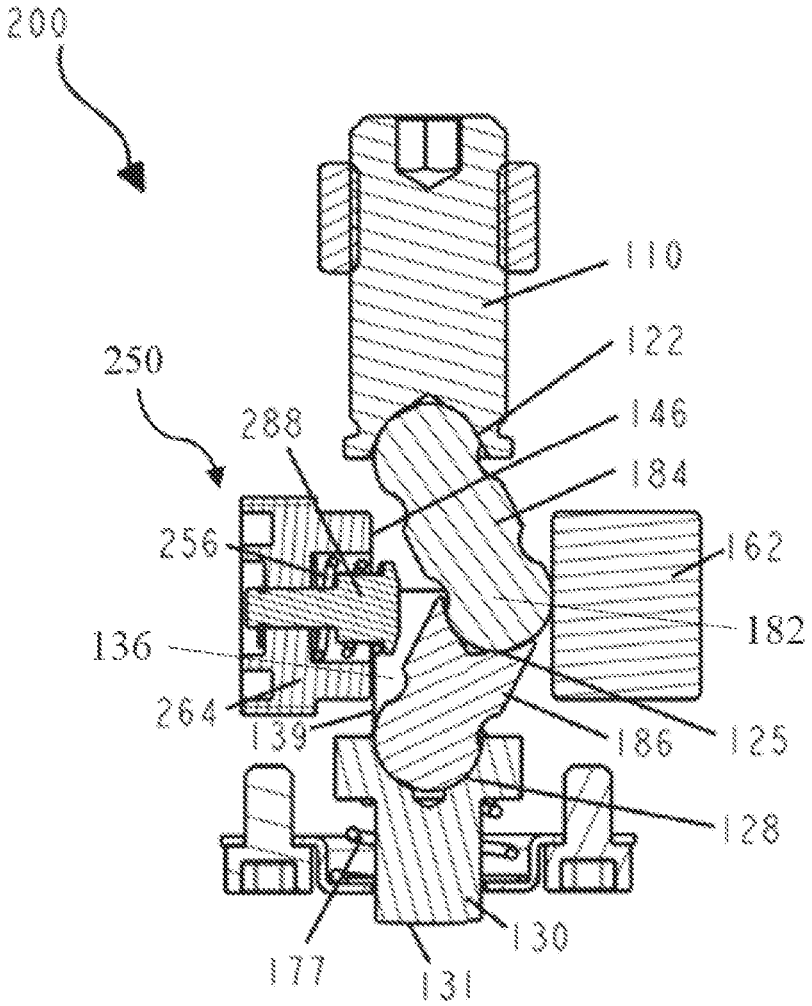
FIG. 6 is a schematic view showing the engine valve actuating apparatus in an inoperative condition, with a positioning mechanism in an extended position according to a further embodiment of the present invention.
Figure 7:
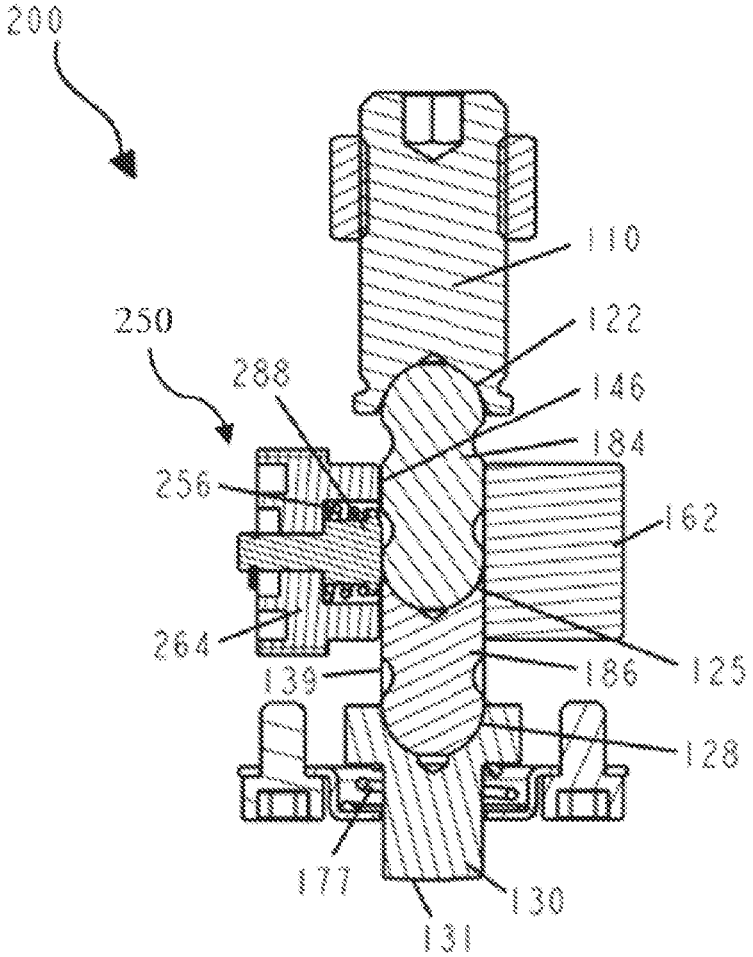
FIG. 7 is a schematic view showing the engine valve actuating apparatus in an operative condition, with the positioning mechanism in a retracted position according to this further embodiment of the present invention.

As shown in FIGS. 6 and 7, the positioning mechanism 250 of this engine valve actuating apparatus 200 includes a positioning member 264 having a hole 203 therein and a pushrod 288. The pushrod 288 includes cylindrical surfaces 202, 212 and 223 of different diameters that form step surfaces 206 and 209. One of the cylindrical surfaces 202 forms a slidable fit with the hole 203 of the positioning member 264. In the embodiment shown in FIGS. 6-9, the positioning member 264 is a screw plug that is screwed into the housing 210. The diameter of the largest cylindrical surface 223 of the pushrod 288 is smaller than the width of the guide groove 237, as shown in FIG. 4. The end face 211 of the pushrod 288 at the largest cylindrical surface 223 is a retaining surface 211 that maintains the first link 184 and the second link 186 in a substantially coaxial position when the link mechanism 182 is at the second position, as shown in FIG. 6. The end face 246 of the cylindrical surface 204 of the positioning member 264 is in contact with the anti-rotation surfaces 139 of the actuation piston 130, as shown in FIGS. 6 and 7.

Figure 8:
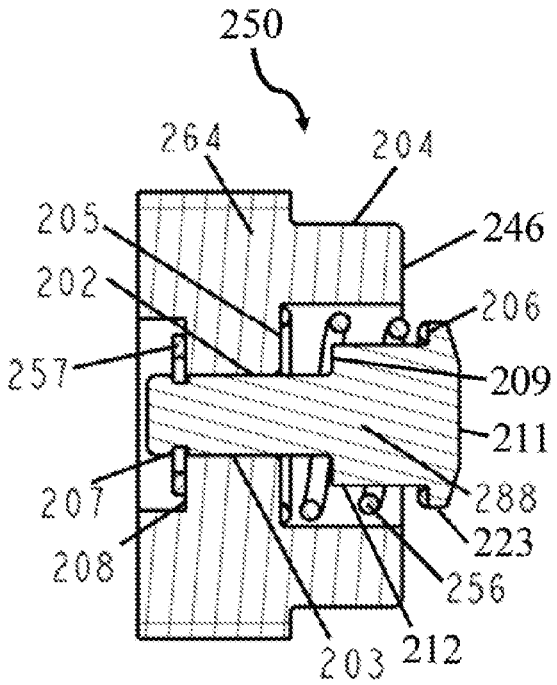
FIG. 8 is a schematic view showing the positioning mechanism of the engine valve actuating apparatus in an extended position according to this further embodiment of the present invention.
Figure 9:
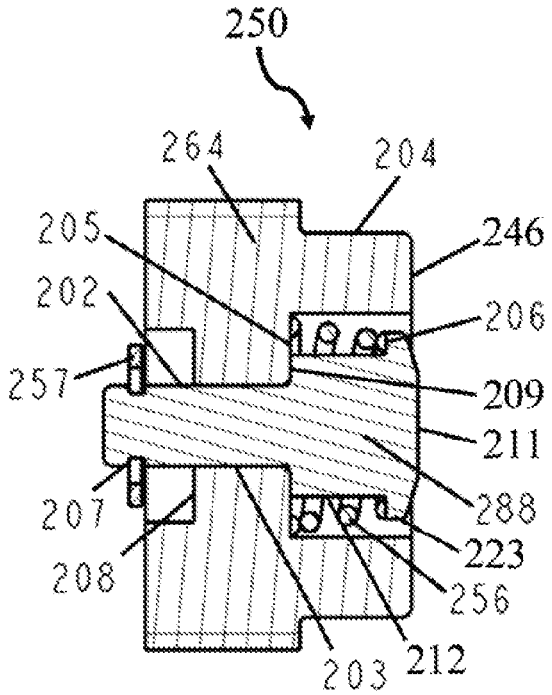
FIG. 9 is a schematic view showing the positioning mechanism of the engine valve actuating apparatus in a retracted position according to the further embodiment of the present invention.

As shown in FIGS. 8 and 9, the positioning mechanism 250 further includes a returning spring 256 and a retaining ring 257. Two ends of the returning spring 256 are disposed on the step surface 206 of the pushrod 288 and the retaining surface 205 of the positioning member 264, respectively. The retaining ring 257 is clipped on the pushrod 288 in a ring groove 207. The pushrod 288 is slidably disposed within the hole 203 of the positioning member 264 and has a retracted position (shown in FIGS. 7 and 9) and an extended position (shown in FIGS. 6 and 8). The retaining ring 257 and the step surface 209 set the stroke of the pushrod 288 between the retracted position and extended position.

When engine oil is supplied to the activation piston bore 160 through a fluid passage 214 in the housing 210, the pressure of the engine oil acts on the activation piston 162 to overcome the forces of the returning spring 256 and the actuation piston spring 177, and to push the link mechanism 182 from the second position to the first position along the guide groove 137. And the actuation piston 130 moves downward to engage the engine valve. The pushrod 288 of the positioning mechanism 250 moves from the extended position to the retracted position, and the step surface 209 of the pushrod 288 rests on the retaining surface 205 of the positioning member 264. The retaining surface 211 of the pushrod 288 keeps the first link 184 and the second link 186 coaxial in a vertical position as shown in FIG. 7.

When the oil pressure in the activation piston bore 160 in the housing 210 is released, the returning spring 256 of the positioning mechanism 250 pushes the pushrod 288 from the retracted position (shown in FIGS. 7 and 9) to the extended position (shown in FIGS. 6 and 8), and the link mechanism 182 moves from the second position to the first position, with the activation piston 162 pressed against the bottom surface 246 of the activation piston bore 260 (shown in FIG. 1). At the same time, the actuation piston spring 177 moves the actuation piston 130 upward, and the actuation piston 130 is disengaged with the engine valve.

Figure 10:
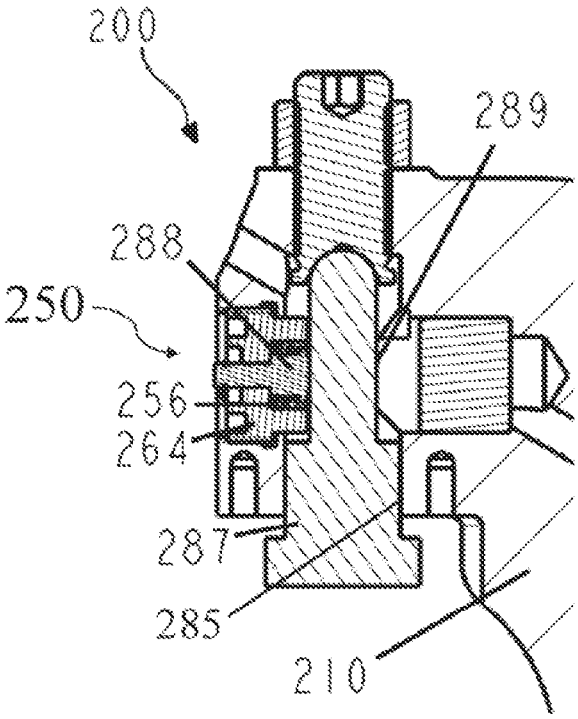
FIG. 10 is a schematic view showing a positioning method of the engine valve actuating apparatus according to the further embodiment of the present invention.

FIG. 10 illustrates a method for setting the positioning mechanism 250 using an assembly fixture 287 that has a large cylindrical surface 285 and a small cylindrical surface 289. The large cylindrical surface 285 has a slidable fit with the actuation piston bore 190, and the small cylindrical surface 289 has the same or a similar diameter as the first link 184 or second link 186. The method has the following steps:

installing an activation piston in an activation piston bore;

installing an assembly fixture in the actuation piston bore, wherein the assembly fixture includes a large cylindrical surface and a small cylindrical surface, the large cylindrical surface forming a slidable fit with an actuation piston bore, and the small cylindrical surface having the same or a similar diameter as a first link or a second link;

inserting a positioning member of a positioning mechanism in a housing until a pushrod of the positioning mechanism contacts the small cylindrical surface of the assembly fixture and generates a predetermined installation resistant force;

fastening the positioning member of the positioning mechanism on the housing;

removing the assembly fixture from the actuation piston bore; and installing the connecting bars and other parts of the engine valve actuating device.

The method may also include the step of fastening the positioning member to the rocker arm includes welding, riveting, impacting threads, and the like.

The exemplar embodiments of the present invention illustrate the invention, but do not intend to limit it. Indeed, it will be apparent to those skilled in the art that various modifications and variations can be made in the invention without departing from the scope or spirit of the invention. For example, a portion of the function illustrated or described by one particular mechanism may be utilized by another particular mechanism to yield a new mechanism. The housing in the embodiment can be not only a rocker arm, but also a valve bridge or even a fixed housing. In addition, the return spring of the positioning mechanism may be another form of spring, e.g. a leaf spring. Further, the positioning member of the positioning mechanism may be other parts besides the screw plug with different installation and fixation mode. An engine valve actuating apparatus of the present invention may produce other types of variable valve motion in addition to the valve motion that may lead engine braking. Therefore, the invention will include the above modifications and variations provided they fall within the scope of the appended claims or equivalents thereof.

The invention claimed is:

1. An engine valve actuating apparatus, comprising:

a housing including an activation piston bore and an actuation piston bore;

an activation piston configured to slide within the activation piston bore;

an actuation piston configured to slide within the actuation piston bore, the actuation piston including at least one side surface in sliding contact with an inner cylindrical surface of the actuation piston bore;

a link mechanism configured to switch between a first position and a second position, the link mechanism including:

a first link, a second link, a first rotational coupling connecting the first link to the housing, a second rotational coupling connecting the first link to the second link, and a third rotational coupling connecting the second link to the actuation piston; and a guide mechanism configured to guide the first and second links so as to move along a plane when the link mechanism is switched between the first position and the second position, wherein the actuation piston is disengaged from an engine valve when the link mechanism is in the first position, wherein the actuation piston is engaged with the engine valve when the link mechanism is in the second position so as to actuate the engine valve, and wherein at least a portion of the guide mechanism is below at least a portion of the at least one side surface of the actuation piston.

2. The engine valve actuating apparatus according to claim 1, wherein the first link is angled with respect to the second link when the link mechanism is in the first position, and wherein the first link is coaxially aligned with the second link when the link mechanism is in the second position.

3. The engine valve actuating apparatus according to claim 1, wherein the actuation piston and the guide mechanism form an integral or unitary part.

4. The engine valve actuating apparatus according to claim 1, wherein the guide mechanism comprises a guide groove, and wherein the second link is disposed in the guide groove.

5. The engine valve actuating apparatus according to claim 4, wherein the actuation piston further includes an anti-rotation mechanism with an anti-rotation surface perpendicular to the guide groove, the anti-rotation surface configured to limit rotation of the actuation piston within the actuation piston bore.

6. The engine valve actuating apparatus according to claim 5, further comprising a positioning mechanism configured to alternately position the link mechanism in the first position and in the second position.

7. The engine valve actuating apparatus according to claim 6, wherein the positioning mechanism includes a positioning member with an end surface configured to engage the anti-rotation surface.

8. The engine valve actuating apparatus according to claim 6, wherein the positioning mechanism includes a positioning member with a hole, and a pushrod slidably disposed in the hole, and wherein the pushrod is configured to switch between a retracted position which positions the link mechanism in the second position, and an extended position which positions the link mechanism in the first position.

9. The engine valve actuating apparatus according to claim 8, wherein the positioning member further includes an end surface configured to engage the anti-rotation surface.

10. The engine valve actuating apparatus according to claim 8, wherein the pushrod includes a plurality of cylindrical surfaces of different diameters so as to form stepped surfaces, wherein a first cylindrical surface of the plurality of cylindrical surfaces forms a sliding fit with the hole of the positioning member, wherein the diameter of a largest cylindrical surface of the plurality of cylindrical surfaces is less than a width of the guide groove, and wherein an end surface of the largest cylindrical surface is a positioning surface configured to engage the link mechanism when the link mechanism is in the second position.

11. The engine valve actuating apparatus according to claim 8, wherein the positioning mechanism further includes a returning spring arranged on the pushrod, the returning spring configured to bias the link mechanism towards the first position.

12. The engine valve actuating apparatus according to claim 8, wherein the positioning member is a screw plug that is screwed into the housing.

13. The engine valve actuating apparatus according to claim 1, further comprising an actuation piston spring configured to keep the actuation piston in contact with the second link.

14. The engine valve actuating apparatus according to claim 1, wherein the housing further includes a fluid channel connecting the activation piston bore to an engine oil supply, and wherein engine oil pressure from the engine oil supply acts on the activation piston in the activation piston bore so as to move the link mechanism from the first position to the second position.

15. The engine valve actuating apparatus according to claim 1, wherein the housing further includes a valve lash adjusting screw, and wherein the valve lash adjusting screw and the first link form the first rotational coupling.

16. The engine valve actuating apparatus according to claim 1, wherein the housing is a rocker arm of an engine.

17. An engine valve actuating apparatus, comprising:

a housing including an activation piston bore and an actuation piston bore;

an activation piston configured to slide within the activation piston bore;

an actuation piston configured to slide within the actuation piston bore, the actuation piston including:

at least one side surface in sliding contact with an inner cylindrical surface of the actuation piston bore, and an anti-rotation mechanism configured to limit rotation of the actuation piston within the actuation piston bore, at least a portion of the anti-rotation mechanism disposed below at least a portion of the at least one side surface; and a link mechanism configured to switch between a first position and a second position, the link mechanism including:

a first link, a second link, a first rotational coupling connecting the first link to the housing, a second rotational coupling connecting the first link to the second link, and a third rotational coupling connecting the second link to the actuation piston, wherein the actuation piston is disengaged from an engine valve when the link mechanism is in the first position, and wherein the actuation piston is engaged with the engine valve when the link mechanism is in the second position so as to actuate the engine valve.

18. A method for positioning an engine valve actuating device including a link mechanism with a first link and a second link, the method comprising:

installing an activation piston in an activation piston bore of a housing;

installing an assembly fixture in an actuation piston bore of the housing, the assembly fixture including a first cylindrical surface with a first diameter, and a second cylindrical surface with a second diameter less than the first diameter, the first cylindrical surface forming a slidable fit with the actuation piston bore, and the second diameter being equal to a diameter of the first link or of the second link;

inserting a positioning mechanism, comprising a positioning member and a pushrod, in the housing until the pushrod contacts the second cylindrical surface and generates a predetermined installation resistant force;

fastening the positioning member to the housing;

removing the assembly fixture from the actuation piston bore; and installing the link mechanism and an actuation piston into the actuation piston bore.

19. An engine valve actuating apparatus, comprising:

a housing including an activation piston bore and an actuation piston bore;

an activation piston configured to slide within the activation piston bore;

an actuation piston configured to slide within the actuation piston bore so as to actuate an engine valve;

a positioning mechanism; and a link mechanism configured to switch between a first position and a second position, wherein the positioning mechanism is configured to move the link mechanism into the first position, wherein the activation piston is further configured to move the link mechanism to the second position, and wherein the actuation piston includes a narrowed top portion configured to at least partially extend into a space between the positioning mechanism and the activation piston so as to form a sliding fit with a cylindrical inner surface of the actuation piston bore, the sliding fit guiding movement of the actuation piston in the actuation piston bore.

20. The engine valve actuating apparatus according to claim 19, wherein the actuation piston further includes a cylindrical bottom portion with a diameter sufficient to prevent the cylindrical bottom portion from extending into the space between the positioning mechanism and the activation piston.

* * * * *